US010975630B1

(12) United States Patent
Al Haji

(10) Patent No.: US 10,975,630 B1
(45) Date of Patent: Apr. 13, 2021

(54) EXPANSION TUBING JOINT WITH EXTENDABLE CABLE

(71) Applicant: SAUDI ARABIAN OIL COMPANY, Dhahran (SA)

(72) Inventor: Ahmed Mohammed Al Haji, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/783,817

(22) Filed: Feb. 6, 2020

(51) Int. Cl.
*E21B 17/07* (2006.01)
*E21B 17/02* (2006.01)

(52) U.S. Cl.
CPC ..... *E21B 17/07* (2013.01); *E21B 17/028* (2013.01)

(58) Field of Classification Search
CPC ..... E21B 17/02; E21B 17/07
See application file for complete search history.

(56) References Cited

U.S. PATENT DOCUMENTS

| | | | | |
|---|---|---|---|---|
| 4,024,718 | A | 5/1977 | Roche et al. | |
| 4,683,349 | A | 7/1987 | Takebe | |
| 5,191,173 | A | 3/1993 | Sizer et al. | |
| 6,422,324 | B1 | 7/2002 | Tibussek et al. | |
| 2004/0108109 | A1* | 6/2004 | Allamon | E21B 23/04 166/243 |
| 2010/0007519 | A1 | 1/2010 | Madhavan et al. | |
| 2010/0108332 | A1 | 5/2010 | Chaplin et al. | |
| 2012/0111555 | A1 | 5/2012 | Leveau et al. | |
| 2013/0153207 | A1* | 6/2013 | Lauderdale | E21B 23/02 166/123 |

FOREIGN PATENT DOCUMENTS

| | | | |
|---|---|---|---|
| CN | 106437538 | A | 2/2017 |
| CN | 109882080 | A | 6/2019 |
| GB | 2441467 | A | 3/2008 |

* cited by examiner

*Primary Examiner* — Giovanna Wright
*Assistant Examiner* — Yanick A Akaragwe
(74) *Attorney, Agent, or Firm* — Osha Bergman Watanabe & Burton LLP

(57) ABSTRACT

A downhole tubing joint assembly may have a first tubular and a second tubular axially movably disposed within the first tubular. The second tubular may have an initial position, a free-moving position, and a locked position. Additionally, at least one shear pin may be disposed between the first tubular and the second tubular. The shear pin may hold the second tubular in the initial position and is configured to shear upon application of a predetermined force. Further, a locking device may couple the first tubular and the second tubular together in the locked position. Furthermore, a cable may be connected to the first tubular. The cable may provide power to downhole tools. The cable is folded when the second tubular is in the initial position, and is extended when the second tubular is in the locked position.

20 Claims, 4 Drawing Sheets

EXPANSION TUBING JOINT WITH EXTENDABLE CABLE

BACKGROUND

In the oil and gas industry, operations may be performed in a wellbore at various depths below the surface. In order to recover hydrocarbons from a well, any number of electrical systems may be deployed for providing power within the wellbore to perform various operations. Many of these electrical systems need high-reliability power grids and power control units located on the surface or rig to power various devices. Power systems play a major role in providing the required and reliable power to the various electrical systems. In conventional methods, power is provided from external sources to the downhole tools via cable conductors to submerged process control equipment, pumps and compressors, transformers, motors, and other electrically operated equipment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a downhole tubing joint assembly. The downhole tubing joint assembly may include a first tubular and a second tubular axially movably disposed within the first tubular. The second tubular may have an initial position, a free-moving position, and a locked position. Additionally, at least one shear pin may be disposed between the first tubular and the second tubular. The shear pin may hold the second tubular in the initial position and is configured to shear upon application of a predetermined force. Further, a locking device may couple the first tubular and the second tubular together in the locked position. Furthermore, a cable may be connected to the first tubular. The cable may provide power to downhole tools. The cable is folded when the second tubular is in the initial position, and is extended when the second tubular is in the locked position.

In another aspect, the embodiments disclosed herein relate to a downhole tubing string system. The downhole tubing string system may include a tubing string, with at least one downhole tool, disposed within a wellbore. Additionally, a tubing joint assembly may be disposed in the tubing string and coupled to the downhole tool. The downhole tool is downhole from the tubing joint assembly. The tubing joint assembly may include a first tubular and a second tubular axially, movably disposed within the first tubular, wherein the second tubular has an initial position, a free-moving position, and a locked position; a shear pin configured to hold the second tubular in the initial position and to shear upon application of a predetermined force; a locking device configured to lock the second tubular in the locked position with respect to the first tubular; and a foldable cable extending along an outer surface of the first tubular, the foldable cable having a first end and a second end, the first end coupled to the first tubular and the second end coupled to the second tubular. Further, an electric cable or hydraulic line may extend from a power source and connected to a first connection head on the first end of the foldable cable. A second connection head on the second end of the foldable cable may be operatively connected to and conveys power to the downhole tool from the electric cable or hydraulic line.

In yet another aspect, the embodiments disclosed herein relate to a method. The method may include shrinking or elongating a first tubular and/or a second tubular of a tubing joint assembly in a tubing string disposed in a wellbore, wherein the second tubular is disposed within the first tubular; shearing a shear pin of the tubing joint assembly that is provided between the first tubular and the second tubular; axially moving one of the first tubular or the second tubular within the tubing joint assembly; extending a cable coupled to the tubing joint assembly while axially moving one of the first tubular or the second tubular; locking the second tubular to the first tubular with a locking device after the axially moving one of the first tubular or the second tubular; conveying power from a power source at a surface of the wellbore down to the cable via an electric cable or hydraulic line extending from the surface of the wellbore; and providing power to a downhole tool below the tubing joint assembly via the cable.

Other aspects and advantages will be apparent from the following description and the appended claims.

DETAILED DESCRIPTION

Figure 1:
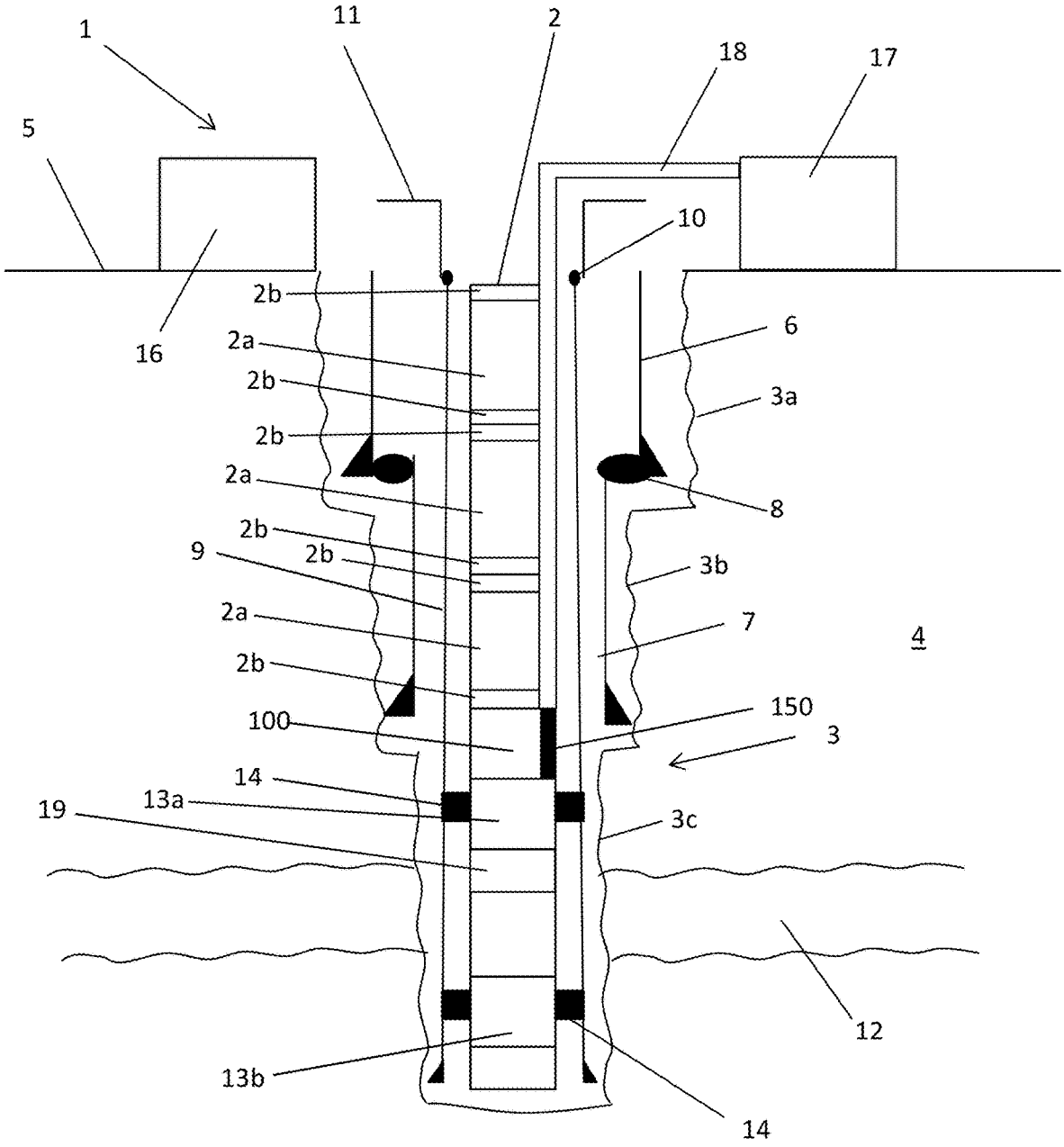
FIG. 1 shows a completion rig system in accordance with one or more embodiments.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" "attached" or "attached to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification. In addition, any terms designating tubular or tubing joint (i.e., a length of pipe that provides a conduit through which oil and/or gas may be produced) should not be deemed to limit the scope of the disclosure. As used herein, fluids may refer to slurries, liquids, gases, and/or mixtures thereof. It is to be further understood that the various embodiments described herein may be used in various stages of a well, such as rig site preparation, drilling, completion, abandonment etc., and in other environments, such as work-over rigs, fracking installation, well-testing installation, oil and gas production installation, without departing from the scope of the present disclosure. The different embodiments described herein may provide an expansion tubing with an extendable cable that plays a valuable and useful role in the life of a well. Further, the expansion tubing assembly configuration and arrangement of components for providing electrical power to downhole tools according to one or more embodiments described herein may provide a cost-effective alternative to conventional systems. The embodiments are described merely as examples of useful applications, which are not limited to any specific details of the embodiments herein.

Embodiments disclosed herein relate generally to subsea oil and gas operations equipment. More specifically, embodiments disclosed herein relate to systems and methods of use for an expansion tubing to provide power to downhole tools. In one aspect, embodiments disclosed herein relate to an expansion tubing joint with an extendable cable, such as electrical or hydraulic line that may be used to provide power to downhole tools, for example. The expansion tubing joint with an extendable cable may also be interchangeably referred to as a tubing joint assembly in the present disclosure. A tubing joint assembly in accordance with embodiments disclosed herein may allow for elongation and shrinkage of a tubing string while still providing power to downhole tools. Tubular movement of downhole tools may damage the cables. For example, tubulars may elongate when a temperature downhole increases and shrink when the temperature downhole decreases. Further to temperature changes, any change in the properties of the downhole fluids may also cause the tubulars to elongate or shrink and damage the cables running downhole to convey power to downhole tools.

According to embodiments of the present disclosure, the tubing joint assembly is an apparatus that may include a first tubular and a second tubular axially movably coupled within the first tubular. In a non-limiting example, a cable is folded and mounted to have a first end coupled to the first tubular and a second end anchored to the second tubular. Additionally, the cable may extend based on a movement of the second tubular. One skilled in the art will appreciate that by conductively or operatively connecting the cable of the tubing joint assembly to a power source, power may be provided through the tubing joint assembly and to downhole tools.

FIG. 1 shows a block diagram of a system in accordance with one or more embodiments. FIG. 1 shows a completion system 1 according to one or more embodiments. A wellbore 3 may be located in the earth 4 having a surface 5. The wellbore 3 may have a surface portion 3*a*, an intermediate portion 3*b* downhole from the surface portion 3*a*, and a production portion 3*c* downhole from the intermediate portion 3*b*. The surface portion 3*a* may be sealed and cemented by a surface casing 6. Additionally, an intermediate casing 7 hanging from a casing hanger 8 coupled on the surface casing 6 may be sealed and cemented in the intermediate portion 3*b*. Further, a production casing 9 may hang from a casing hanger 10 within a wellhead 11 to extend down into a production zone 12 of the production portion 3*c* or the production casing 9 may extend down to a top of the production zone 3*c*. Furthermore, a fluid system 16 may be provided on the surface 5 to pump fluids in or out of the wellbore 3. In addition, a power system 17 may be provided on the surface 5 to provide power to various components of the completion system 1 on the surface 5 and within the wellbore 3.

In order to produce hydrocarbons form the production zone 12, a tubular string 2 may be disposed within the wellbore 3 extending from the surface 5 to within the production zone 12. The tubular string 2 may include various tubulars 2*a* connected with joint connections 2*b* and downhole tools made up together to form a continuous tubular string. It is further envisioned that one or more packers (13*a*, 13*b*) and one or more electric submersible pumps 19 may be disposed along the tubular string 2. The packer (13*a*, 13*b*) may be a production packer to seal an annulus between the tubular string 2 and the production casing 9. In one embodiment, a first packer 13*a* may be set above a production zone 12 of the reservoir and a second packer 13*b* may be set below the production zone 12. Further, the packers (13*a*, 13*b*) may employ flexible, elastomeric elements 14 that expand when the packer is set to provide a seal against the production casing 9, which may control a reservoir pressure of the production zone 12.

In one or more embodiments, the tubular string 2 may include a tubing joint assembly 100. The tubing joint assembly 100 may be above the one or more packers 13 (or any anchorage point) and below one of the joint connections 2*b* of the tubular string 2. In addition, the tubing joint assembly 100 may include a cable 150 to convey electrical or hydraulic power from the power system 17 to downhole tools, such as pumps, packers, etc. The cable 150 may be a foldable flat-pack. The foldable flat-pack may allow for the cable 150 to be folded without the need of a tie down to keep the cable 150 folded. Additionally, the foldable flat-pack may also minimize a storage space needed in the tubing joint assembly 100 to store the cable 150. A first end of the cable 150 may be operatively connected to power system 17 via an electric cable or hydraulic line 18. A connection head may be provided to seal over the first end of the cable 150. In some embodiments, the connection head may be a motor lead extension for electric power conveyance or a hydraulic wet connect tool for hydraulic power conveyance. In a non-limiting example, the power system 17 splices power to feed the electric cable or hydraulic line 18 running down wellbore 3 from the surface 5 to the cable 150 of the tubing joint assembly 100. Additionally, a second end of the cable 150 may be operatively connected to the first packer 13*a* to convey the electric power or the hydraulic power to the first packer 13*a* and other downhole tools (e.g., electric submersible pump, various downhole sensors and monitoring systems, packers, etc.). For example, the first packer 13*a* may be a feed-through production packer with a bypass or conduit for passing electric lines or hydraulic power lines through the packer to below the first packer 13*a*. The tubing joint assembly 100 will be described in more detail with respect to FIGS. 2A-4B.

Figure 2A:
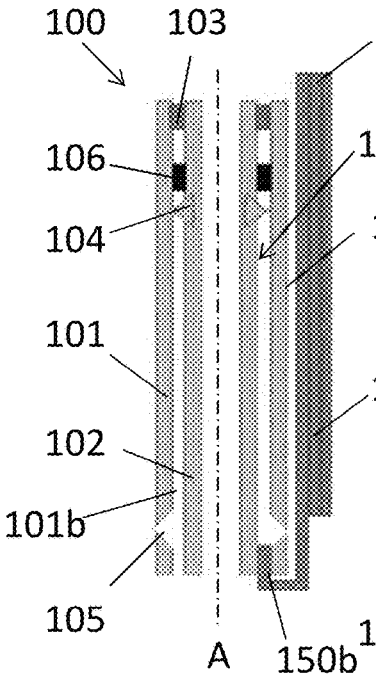
FIGS. 2A-2C show cross-sectional views of an expansion tubing joint in accordance with one or more embodiments of the present disclosure.
Figure 2B:
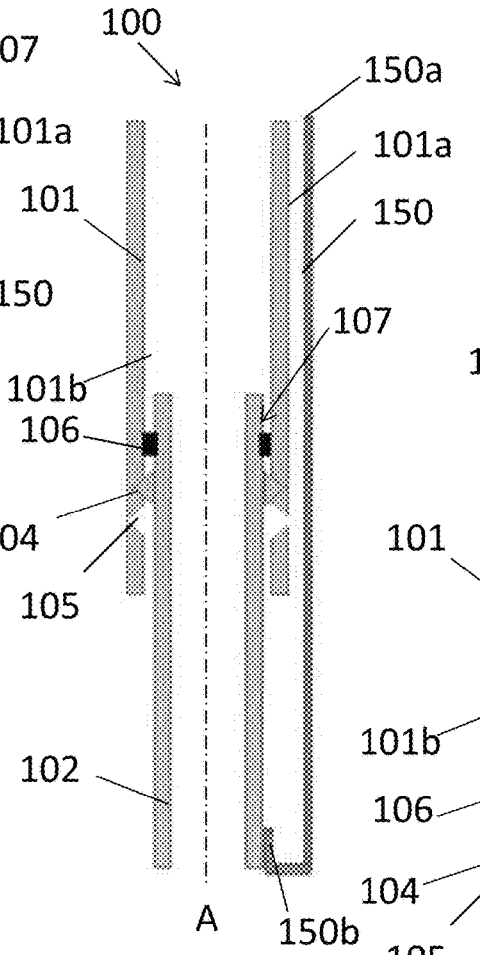
Figure 2C:
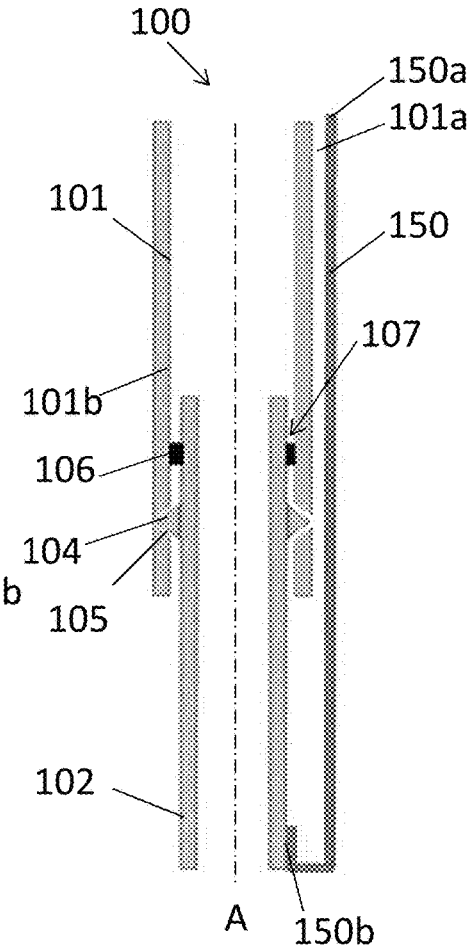

Now referring to FIGS. 2A-2C, in one or more embodiments, FIGS. 2A-2C illustrate a cross-sectional view of the tubing joint assembly 100 in accordance with the present disclosure. The tubing joint assembly 100 may include a first tubular 101 and a second tubular 102. The first tubular 101 may be larger than the second tubular 102 such that an inner diameter of the first tubular 101 is larger than an outer diameter of the second tubular 102. The second tubular 102 is coupled within the first tubular 101 so that the second tubular 102 may axially move up and down within at least a portion of the first tubular 101, thereby providing an expansion joint. In some embodiments, the first tubular 101, may move axially with respect to a fixed second tubular 102. The first tubular 101 and the second tubular 102 may be coaxial to an axis A of the tubular string (see 2 in FIG. 1). Additionally, in some embodiments, a full length of the first tubular 101 and a full length of the second tubular 102 may be equal to each other. Further, one or more shear pins 103 disposed between the first tubular 101 and the second tubular 102 may initially couple the first tubular 101 and the second tubular 102 together and therefore limit relative axial movement between the first tubular 101 and the second tubular 102.

In one or more embodiments, a locking device may be positioned between the first tubular and the second tubular to secure the second tubular to the first tubular. In one or more embodiments, the locking device, such as a plurality of dogs 104, may be provided at an upward end of the second tubular 102. The upward end may be an uphole end of the second tubular 102 (i.e., closer toward the surface opening of the wellbore) (see 3 in FIG. 1). The plurality of dogs 104 may be spring loaded latches that may lock into internal notches, ledges, or grooves 105 formed on an inner surface 101*b* of the first tubular 101. It is further envisioned that the plurality of dogs 104 may be replaced with a shoulder, split ring, or any mechanical fasteners without departing form the present scope of the disclosure. One skilled in the art will appreciate how the internal notches, ledges, or grooves 105 may be positioned along any vertical location on the inner surface 101*b* of the first tubular 101 to delimit a maximum downward movement of the second tubular 102 without departing from the scope of the present disclosure.

In some embodiments, a seal 106 may be provided in annulus 107 between the first tubular 101 and the second tubular 102 to isolate the plurality of dogs 104 from fluid flowing through the tubulars 101, 102. For example, the seal 106 may be coupled to the second tubular 102 and extend radially outward to seal against the inner surface 101*b* of the first tubular 101. In addition, the seal 106 may be positioned above the plurality of dogs 104. In other embodiments, the seal 106 may be positioned below the plurality of dogs 104. In still other embodiments, the tubing joint assembly 100 may include a seal 106 positioned above and a seal positioned below the plurality of dogs 104. Further, the seal 106 may be fixed to the second tubular 102 such that the seal 106 moves in conjunction with the axial movement of the second tubular 102.

In one or more embodiments, at an upward end of the tubing joint assembly 100, a first end 150*a* of the cable 150 may be connected to a power system (see 17 in FIG. 1) via electric cable or hydraulic line (see 18 in FIG. 1) running down wellbore 3 (see 3 in FIG. 1). At a downward end of the tubing joint assembly 100, opposite the upward end of the tubing joint assembly 100, a second end 150*b* of the cable 150 may be attached to the second tubular 102 via a connection head. In addition, the cable 150 may be a foldable flat-pack that is folded and positioned along an outer surface 101*a* of the first tubular 101. The second end 150*b* of the cable 150 may have a hook or other shape configured to bend or fold around a lower end of the first tubular 101. The configuration of the second end 150*b* of the cable 150 allows the cable 150 to hook or bend around the first tubular 101 and the second end 150*b* of the cable 150 to attach to the second tubular 102. Is it further envisioned that the first tubular 101 may have an outer jacket (not shown) to protect and store the cable 150. For example, the outer jacket or housing (See FIG. 3A) may be a metal shell attached to the outer surface 101*a* of the first tubular 101 for the cable 150 to be positioned and folded within to protect the cable 150 as the tubing joint assembly 100 is run in-hole.

In FIG. 2A, the tubing joint assembly 100 is shown in an initial position within the wellbore (see 3 in FIG. 1). The tubing joint assembly 100 may be in the initial position as the tubing string, and therefore, the tubing joint assembly 100, is run in-hole. When the tubing joint assembly 100 is in the initial position, the full length of the second tubular 102 may be fully within the first tubular 101. Additionally, the shear pins 103 are still intact to secure and maintain the initial position of the second tubular 102 fully within the first tubular 101. Further, while in the initial position, the cable 150 may be fully folded. In a non-limiting example, the cable 150 may be folded over three times and positioned or mounted on the outer surface 101*a* of the first tubular.

In FIG. 2B, the tubing joint assembly 100 is shown in a free-moving position within the wellbore (see 3 in FIG. 1). In the free-moving position, the shear pins 103 have been sheared and the second tubular 102 may freely move axially with respect to the first tubular 101. The shear pins 103 may shear by a shrinkage or elongation of the second tubular 102. The shrinkage or elongation of the second tubular 102 may be caused by a temperature or fluid property change of a fluid within the wellbore (see 3 in FIG. 1). In a non-limiting example, the fluid system (see 16 in FIG. 1) may pump fluids into the wellbore (see 3 in FIG. 1). If the temperature of the pumped fluids lowers the temperature in the wellbore, the second tubular 102 may shrink such that the shear pins 103 are sheared by the relative contraction of the second tubular 102 to allow the second tubular 102 to move axially with respect to the first tubular 101. In some embodiments, once the packer (see 13*a*, 13*b* in FIG. 1) is set in place, pulling the joint connections (see 2*b* in FIG. 1) above the tubing joint assembly 100 may also shear the shear pins 103. Further, if the temperature of the pumped fluids raises the temperature in the wellbore, the second tubular 102 may stretch or elongate such that the shear pins 103 are sheared by the relative expansion of the second tubular 102 to allow the second tubular 102 to move axially with respect to the first tubular 101. In addition, the cable 150 may unfold and extend as the second tubular 102 moves. One skilled in the art will appreciate that the free-moving position may start from when the shear pins 103 shear to when the plurality of dogs 104 latch onto the internal notches, ledges, or grooves 105, as further discussed below.

In FIG. 2C, the tubing joint assembly 100 is shown in a locked position within the wellbore (see 3 in FIG. 1). In the locked the position, the second tubular 102 has moved (after shearing of the shear pins) and a locking device secures the second tubular 102 to the first tubular 101. For example, as shown in FIG. 2C, the second tubular 102 may move to a downward-most position such that the plurality of dogs 104 on the second tubular 102 latch onto the internal notches, ledges, or grooves 105 of the first tubular 101. In some embodiments, the cable 150 may be fully extended when the plurality of dogs 104 are latched within the internal notches, ledges, or grooves 105. In other embodiments, the cable 150 may still have some slack or additional length (i.e., may not be fully extended) when the plurality of dogs 104 are latched within the internal notches, ledges, or grooves 105. Additionally, with the second tubular 102 in the locked position, a length of the second tubular 102 below or extended outside of the first tubular 101 may be greater than a length of the second tubular 102 within the first tubular 101. In a non-limiting example, a third of the full length of the second tubular 102 may remain within the first tubular 101 while two-thirds of the full length of the second tubular 102 extends out of the first tubular 101 when the second tubular is in the locked position.

Fluid flow through the tubular string (see 2 in FIG. 1) or additional temperature and/or fluid property changes may apply an upward or downward force on the first tubular 101 and/or second tubular 102. In some cases, if the upward or downward force is greater than a strength of the first tubular 101 and/or second tubular 102, the first tubular and/or second tubular 102 may start to buckle. To prevent such buckling of and/or reducing stresses in the tubing joint assembly 100, the plurality of dogs 104 may be configured to unlatch from the internal notches, ledges, or grooves 105 at a preset pressure, to allow the expanded tubing joint assembly 100 to compress. In other words, the locking device may be disengaged at a preset pressure to allow the second tubular 102 to move axially uphole within first tubular 101 or the first tubular 101 to move axially downhole around second tubular 102. For example, in order to unlatch the plurality of dogs 104, the plurality of dogs 104 may have a preset pressure threshold or a pressure sensor. Thus when the upward or downward force nears a force or pressure that exceeds the strength of the first tubular 101 and/or the second tubular 102, the plurality of dogs 104 may disengage from the internal notches, ledges, or grooves 105. With the plurality of dogs 104 unlatched, the tubing joint assembly 100 may be in the free-moving position allowing for upward axial movement of the second tubular 102 relative to the first tubular 101 or downward movement of the first tubular 101 relative to the second tubular 102 to avoid buckling. Additionally, the cable 105 may be folded over itself to shorten in length corresponding to an amount of distance the second tubular 102 has axially moved upward.

Figure 3A:
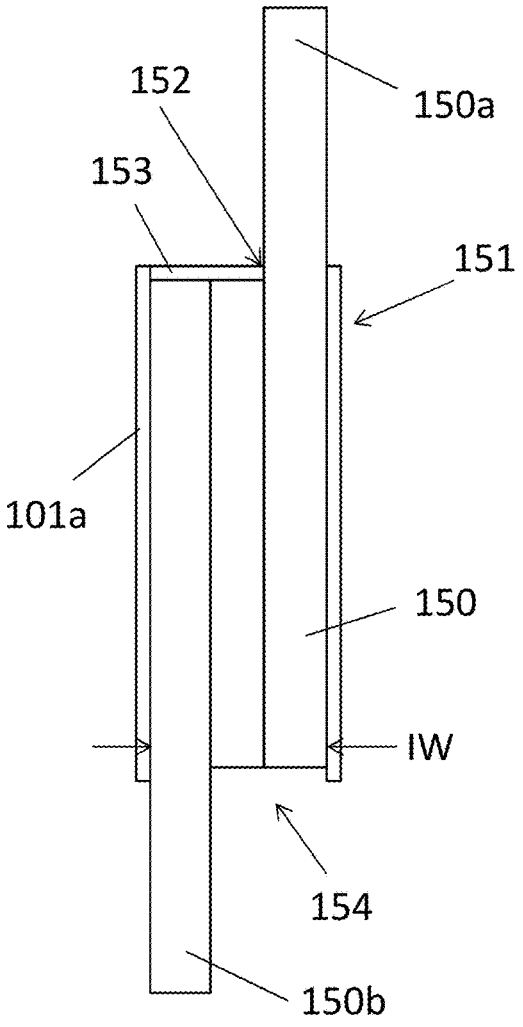
FIGS. 3A and 3B show cross-sectional views of a cable of an expansion tubing joint in accordance with one or more embodiments of the present disclosure.

Referring to FIG. 3A, FIG. 3A illustrates a close-up view of the cable 150 folded within an outer jacket or housing 151 in accordance with one or more embodiments of the present disclosure. The outer jacket 151 may be removably fixed to the outer surface 101*a* of the first tubular (see 101 in FIGS. 2A-2C). The cable 150 may be a foldable flat-pack that is folded within the outer jacket 151 and along the outer surface 101*a* of the first tubular 101. Additionally, the first end 150*a* of the cable 150 may extend out of the outer jacket 151 through an opening 152 in a top plate 153 of the outer jacket 151. The second end 150*b* of the cable 150 may extend out of the outer jacket 151 through a bottom opening 154. The bottom opening 154 may be an opening extending a full length of an inner width IW of the outer jacket 151.

Figure 3B:
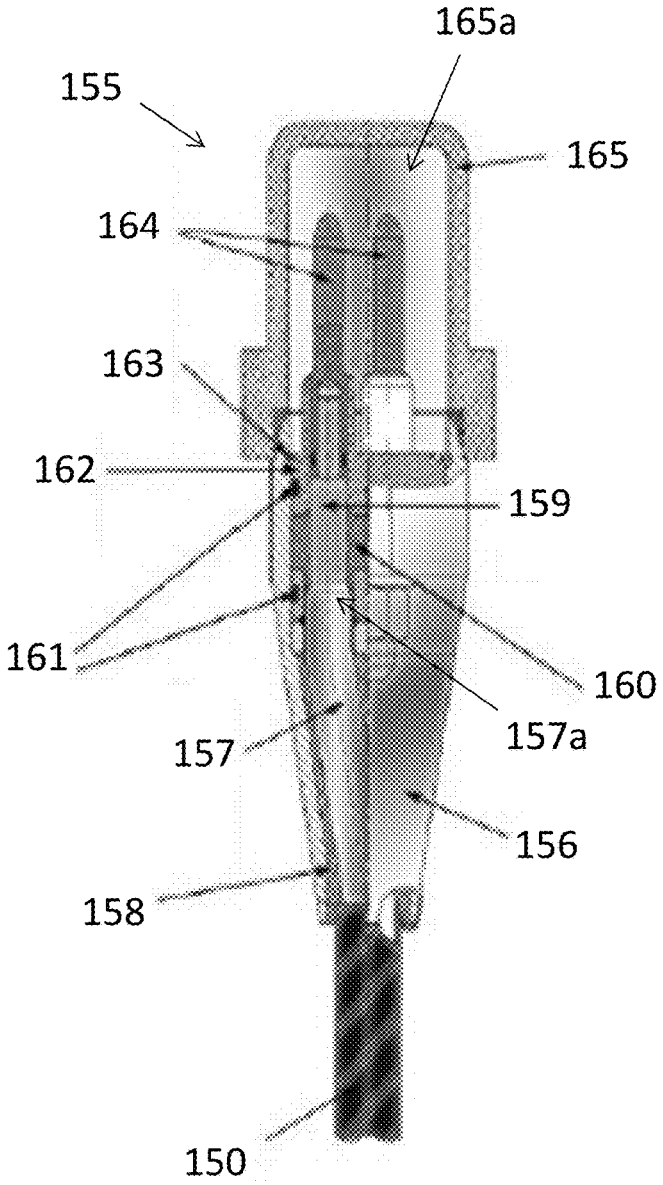

Referring to FIG. 3B, FIG. 3B illustrates a close-up view of a connection head 155 that may be used in accordance with one or more embodiments of the present disclosure. The connection head 155 may be attached to any end (150*a*, 150*b*) of the cable 150. The connection head 155 shown in FIG. 3B is for exampled purposes only and one skilled in the art will appreciate how any type of electric or hydraulic connection may be used without departing from the scope of the present disclosure. A body 156 of the connection head 155 may house the internal components of the connection head 155. Within the body 156, an electrical conduit 157 may be surrounded by a compound resin 158 for protection. Additionally, the electrical conduit 157 is operationally connected to the cable 150. At a distal end 157*a* of the electrical conduit 157 opposite the cable 150, an elastomer 159, such as ethylene-propylene-diene-monomer (EPDM), may be provided with a seal 160. Further, O-rings 161 may be provided at ends of the seal 160. In some embodiments, an insulator 162 may be used to insulate the EPDM. In addition, a thrust ring 163 may be added to support axial loading from pluggable tips 164. The pluggable tips 164 may extend from the body 156 and into a housing 165*a* of the cap 165 that may seal an end of the body 156 opposite the cable 150.

Figure 4A:
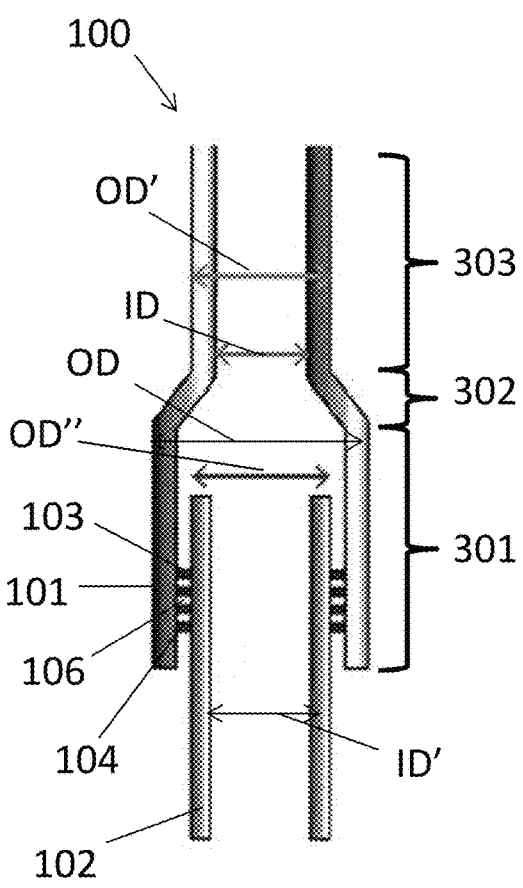
FIGS. 4A-4B show cross-sectional views of an expansion tubing joint in accordance with one or more embodiments of the present disclosure.

FIG. 4A illustrates a close-up view of the tubing joint assembly 100 as described in FIGS. 2A-2C in accordance with one or more embodiments of the present disclosure. For example purposes only, FIG. 4A is shown without the cable (150) to better show the first tubular 101 and the second tubular 102. The first tubular 101 may be a tubing joint that is a box-down connection with three portions: a joint portion 301, a transition portion 302, and a tubing portion 303. The joint portion 301 may have an outer diameter OD larger than an outer diameter OD' of the tubing portion 303. The transition portion 302 connects the joint portion 301 to the tubing portion 303. Additionally, an outer diameter of the transition portion 302 gradually decreases from the outer diameter OD of the joint portion 301 to the outer diameter OD' of the tubing portion 303. Similarly, an inner diameter of the joint portion 301 is larger than an inner diameter of the tubing portion 303, and an inner diameter of the transition portion 302 decreases from the inner diameter of the joint portion to the inner diameter of the tubing portion 303.

In one or more embodiments, the second tubular 102 may be sized to fit within the joint portion 301. Thus, the outer diameter OD" of the second tubular 102 is less than the inner diameter of the joint portion 301. In one or more embodiments, an inner diameter ID of the tubing portion 303 may be less than the outer diameter OD" of the second tubular 102. One skilled in the art will appreciate that the smaller inner diameter ID of the tubing portion 303 may act as an upper limit for the second tubular 102. In addition, the transition portion 302 may act as a stop for the second tubular 102. Further, an inner diameter ID' of the second tubular 102 may be equal to the inner diameter ID of the tubing portion 303.

Figure 4B:
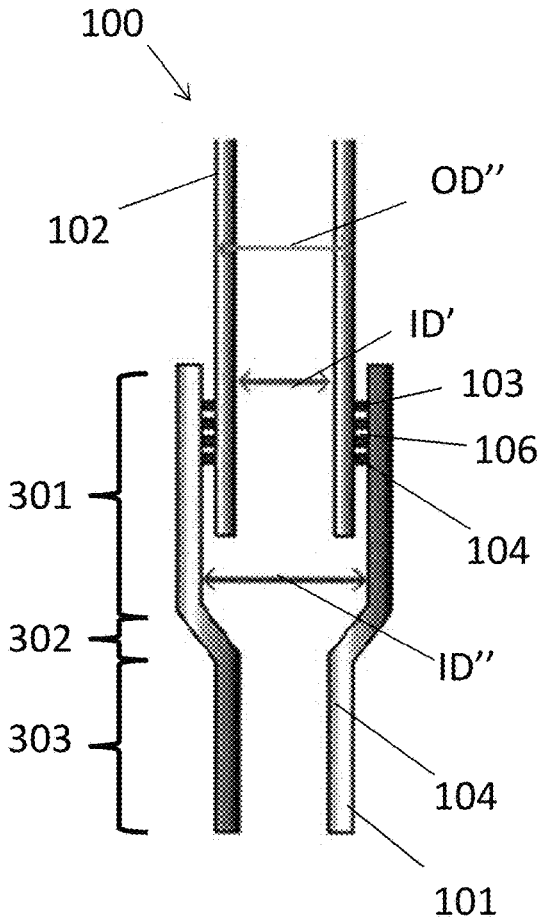

Referring now to FIG. 4B, another embodiment of a tubing joint assembly 100 according to embodiments herein is illustrated, where like numerals represent like parts. The embodiment of FIG. 4B is similar to that of the embodiment of FIG. 4A. However, in place of the first tubular 101 being a tubing joint, the first tubular 101 is a polished bore receptacle (PBR). The PBR may be a box-up connection above an end of a packer (e.g., the first packer 13*a* in FIG. 1) to provide an expansion joint. Thus, in this embodiment, the first tubular 101 is positioned downhole from the second tubular 102, and the first tubular 101 configured to receive the second tubular 102 from an uphole end of the first tubular 101. As shown in FIG. 3B, the outer diameter OD" of the second tubular 102 is less than an inner diameter ID" of the joint portion 301 such that the transition portion 302 may act a stop. However, the inner diameter ID' of the second tubular 102 is the same as the inner diameter of the lower tubular portion of the first tubular 101.

In this embodiment, one or more shear pins 103 may be provided between an uphole end of the first tubular 101 and a downhole end of the second tubular 102 in an initial position of the tubing joint assembly. One or more locking devices (e.g., a plurality of locking dogs 104), may be coupled between the uphole end of the first tubular 101 and the downhole end of the second tubular 102. Similarly, a seal 106 may be provided between the uphole end of the first tubular 101 and the downhole end of the second tubular 102 to isolate the one or more locking devices from fluid.

Methods of the present disclosure may include use of the tubing joint assembly 100 and other structures, such as in FIGS. 1-4B for conveying power (electrical or hydraulic) to downhole devices.

Initially, a wellbore 3 is drilled and casing 6, 7, 9 of various sizes may be cemented against the wellbore 3. To produce hydrocarbons, a tubing string 2 is lowered down the wellbore 3 to a production zone 12 to pump hydrocarbons to a surface 5 above the wellbore 3. The tubing string 2 may include tubulars 2*a* interconnected with tubing connections 2*b* and various downhole tools such as packers 13*a*, 13*b*, electric submersible pumps 19, etc. Additionally, the tubing string 2 may include a tubing joint assembly 100 between the tubular 2*a* and the packer 13*a*, 13*b* or electric submersible pumps 19. The packer 13*a*, 13*b* may be used to seal 14 an annulus between the casing 9 and the tubing string 2 to control a reservoir pressure of the production zone 12. Additionally, the electric submersible pumps 19 may be used for artificial lift operations for lifting fluids up the tubing string 2. In accordance with one or more embodiments, the tubing joint assembly 100 may provide an expansion joint (first and second tubulars 101, 102, collectively) provided with a cable 150 to convey electrical or hydraulic power to the packer 13*a*, 13*b* and electric submersible pumps 19 or other downhole tools when the expansion joint is expanded or contracted. In particular, an electric cable or hydraulic line 18 from a power source 17 at the surface 5 may run into the wellbore 3 and operatively connect to a first connection head on a first end 150*a* of the cable 150 of the tubing joint assembly 100. A second end 150*b* of the cable 150 may be operatively connected to the packer 13*a*, 13*b* via a second connection head on the second end 150*b*. The packer may be a feed-through production packer such that a cable or line connected to the cable 150 may extend through the production packer to provide electrical or hydraulic power to downhole tools, such as the electric submersible pumps 19 from the power source 17.

In some embodiments, fluids may already be present and/or be pumped into or out of the wellbore 3 around or within the tubing string 2. A temperature or fluid property of the pumped fluid may change the temperature or fluid property of fluids within the wellbore 3. In a non-limiting example, if the wellbore temperature is lowered, a first tubular 101 and/or a second tubular 102 of the tubing joint assembly 100 may shrink; while if the wellbore temperature is raised, the first tubular 101 and/or the second tubular 102 may elongate. The shrinkage or elongation of the first tubular 101 and/or the second tubular 102 with respect to the second tubular 102 and/or first tubular 101, respectively, causes shear pins 103 coupling the first tubular 101 and the second tubular 102 together in an initial position to shear. Shearing the shear pins 103 may allow the second tubular 102 to move axially within the first tubular 101.

In one embodiment, the second tubular 102 may move downward with respect to the first tubular 101 or the first tubular 101 may move upward with respect to the second tubular 102. As the second tubular 102 moves to an axially downward position with respect the first tubular 101 (i.e., due to relative axial movement between the first tubular 101 and second tubular 102), a locking device may engage between the first tubular 101 and the second tubular 102. For example, a plurality of dogs 104 of the second tubular 102 may latch into internal notches, ledges, or grooves 105 of the first tubular 101. The plurality of dogs 104 may lock the second tubular 102 to the first tubular 101 in a locked position, such that the second tubular 102 is at least partially extending from a lower end of the first tubular 101. In this way, the tubing joint assembly 100 has expanded in overall length. In one or more embodiments, the dogs 104 may be spring-loaded such that the dogs 104 are biased radially outward. Thus, as the second tubular 102 moves axially within the first tubular 101, the spring moves the dogs 104 radially outward into the internal notches, ledges, or grooves 105 to lock the plurality of dogs 104 and, therefore, the second tubular 102, to the first tubular 101. A seal 106 may be provided in an annulus between the first tubular 101 and the second tubular 102. The seal 106 may be coupled to the second tubular 102 and extend radially outward to seal against the first tubular 101. Additionally, the seal 106 may isolate the plurality of dogs 104 by being set above the plurality of dogs 104 of the second tubular 102.

Additionally, while the shear pins 103 are intact in the initial position, the cable 150 of the tubing assembly 100 may be folded in an outer jacket or housing 151 that is along an outer surface 101*a* of the first tubular 101. The second end 150*b* of cable 150 may be anchored to the second tubular 102 such that the axial movement of the second tubular 102 (i.e., movement caused due to shearing of the shear pins 103 discussed above) may extend the cable 150 a length as the cable 150 unfolds. When the plurality of dogs 104 are locked in place in the locked position, the cable 150 may be fully extended. Further, the axial movement of the first tubular 101 and/or second tubular 102 may extend the second tubular 102 such that a length of the second tubular 102 is extended out of the first tubular 101 while still having a length of the second tubular 102 within the first tubular 101. Such extension of the second tubular 102 allows for the expansion of the tubing string in response to, for example, temperature changes in the wellbore. In some embodiments, the first tubular 101 may be a polished bore receptacle such that the second tubular 102 extends into an uphole end of the first tubular 101. By extending the cable 150, a continuous cable to the packer 13*a* may be formed via the electric cable or hydraulic line 18 operatively connected to the cable 150. With the continuous cable formed, power may be conveyed and provided from the power source 17 at the surface 5, axially across an expansion joint, down through the packer 13*a*, and to the electric submersible pumps 19, or other downhole tool.

Methods disclosed herein may also include disengaging a locking device coupled between the first tubular 101 and the second tubular 102. For example, a force may be applied to the first tubular 101 and/or the second tubular 102 that is greater than a preset pressure of the locking device. In this embodiment, the locking device may be disengaged such that the second tubular 102 may move relative to the first tubular 101 or the first tubular 101 may move relative to the second tubular 102. For example, a force may be applied to the first tubular 101 and/or the second tubular 102 that is greater than a preset pressure of the plurality of locking dogs 104. Once the pressure exceeds the preset pressure, the plurality of locking dogs 104 may disengage from internal notches, ledges, or grooves 105 formed on the inner surface 101*b* of the first tubular 101.

Tubing joint assemblies, according to embodiments herein, are apparatuses that include multiple tubulars movably coupled together with shear pins and a plurality of dogs, and may include an extended cable to convey and provide power to downhole tools. By having the tubulars movably coupled together, damage to the cable and the tubulars from a shrinkage or elongation of the tubulars may be eliminated and allow for the cable to be extended and the tubulars to move. The elimination of cable damage significantly improves the operational safety, reliability, and longevity during, completions, production, and work-over operations, while providing continuous power through the tool joint assembly. In addition, a seal section may be used to environmentally isolate the plurality of dogs. Furthermore, other instruments and devices, including without limitation, sensors and various valves may be incorporated within the tool joint assembly.

Conventional tubing joints and downhole power distribution in the oil and gas industry are typically limited in movement and do not allow for a dedicated power source line to be run downhole. Conventional methods may include an extensive layout and arrangement to ensure the downhole power sources may be properly isolated and effective within said tubing strings. Such conventional methods may be more expensive and have limited power sources that are unreliable and exposed to potential damage.

Accordingly, one or more embodiments of the present disclosure may be used to overcome such challenges as well as provide additional advantages over conventional methods, as will be apparent to one of ordinary skill. In one or more embodiments, a tubing joint assembly may be safer, faster, and lower in cost as compared with conventional methods due, in part, to multiple tubulars moving within each other to allow a cable to extend for assisting in providing power and electricity to well devices. Additionally, the tubing joint assembly may be used for drilling, completion applications, including natural flow, gas lift, and artificial lift systems in onshore and offshore wells. Examples of a tubing joint assembly, according to embodiments herein, may include a first tubular with an axially movably second tubular disposed therein of a nominal tubing string with sizes range from ¾ inches to 4½ inches and above. Additionally, the cable attached to the tubulars of the tubing joint assembly may have any power range required for various well operations. Achieving a successful continuous power connection of a power source at the surface to the cable of the tubing joint assembly in the wellbore is an important part of a well operation to provide power to various downhole tools. Additional challenges further exist in a downhole environment for safely and conductively connecting the tubing joint assembly to the power source while both minimizing costs and providing reliability for future changes to the overall layout of a field or well.

Additionally, the tubing joint assembly may include a plurality of dogs (with a seal section) to lock the two tubulars together in an extended or elongated position, thereby extending the cable to form a continuous power supply that requires no need for a dedicated power source downhole. Overall the tubing joint assembly may minimize product engineering, risk associated with downhole power sources, reduction of assembly time, hardware cost reduction, and weight and envelope reduction.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A downhole tubing joint assembly, comprising:

a first tubular;

a second tubular axially movably disposed within the first tubular, wherein the second tubular has an initial position, a free-moving position, and a locked position;

at least one shear pin disposed between the first tubular and the second tubular, wherein the at least one shear pin holds the second tubular in the initial position and is configured to shear upon application of a predetermined force;

a locking device coupling the first tubular and the second tubular together in the locked position; and a cable connected to the first tubular, wherein the cable provides power to downhole tools, wherein the cable is folded when the second tubular is in the initial position, and wherein the cable is extended when the second tubular is in the locked position.

2. The downhole tubing joint assembly of claim 1, wherein in the initial position, the second tubular is within the first tubular, in the free-moving position, the second tubular moves axially with respect to the first tubular, and in the locked position, the second tubular is at an axially downward position with respect to the first tubular to lock the locking device.

3. The downhole tubing joint assembly of claim 2, further comprising an internal groove formed in an inner surface of the first tubular proximate a downward end of the first tubular, and wherein the locking device is attached to the second tubular and latches in the internal groove.

4. The downhole tubing joint assembly of claim 1, further comprising a seal radially extending from the second tubular to the first tubular, the seal configured to fluidly isolate the locking device.

5. The downhole tubing joint assembly of claim 1, wherein the first tubular is a polished bore receptacle or a tubing joint.

6. The downhole tubing joint assembly of claim 1, wherein the locking device is a plurality of dogs.

7. The downhole tubing joint assembly of claim 1, wherein one end of the cable is attached to the second tubular.

8. The downhole tubing joint assembly of claim 7, wherein the cable is folded and runs along an outer surface of the first tubular and an outer surface of the second tubular when the second tubular is in the locked position.

9. A downhole tubing string system, comprising:

a tubing string, with at least one downhole tool, disposed within a wellbore;

a tubing joint assembly disposed in the tubing string and coupled to the downhole tool, wherein the downhole tool is downhole from the tubing joint assembly, and the tubing joint assembly comprises:

a first tubular and a second tubular axially, movably disposed within the first tubular, wherein the second tubular has an initial position, a free-moving position, and a locked position;

a shear pin configured to hold the second tubular in the initial position and to shear upon application of a predetermined force;

a locking device configured to lock the second tubular in the locked position with respect to the first tubular; and a foldable cable extending along an outer surface of the first tubular, the foldable cable having a first end and a second end, the first end coupled to the first tubular and the second end coupled to the second tubular; and an electric cable or hydraulic line extending from a power source and connected to a first connection head on the first end of the foldable cable, wherein a second connection head on the second end of the foldable cable is operatively connected to and conveys power to the downhole tool from the electric cable or hydraulic line.

10. The downhole tubing string system of claim 9, wherein the downhole tool is a feed-through production packer.

11. The downhole tubing string system of claim 9, wherein a tubing joint of the tubing string is coupled to an upper end of the tubing joint assembly.

12. The downhole tubing string system of claim 9, further comprising an outer jacket provided on an outer surface of the first tubular, wherein the outer jacket stores the foldable cable.

13. The downhole tubing string system of claim 10, further comprising a second downhole tool, wherein the second downhole tool is an electric submersible pump, and wherein the foldable cable is operatively connected to and conveys power to the electric submersible pump.

14. A method, comprising:

shrinking or elongating a first tubular and/or a second tubular of a tubing joint assembly in a tubing string disposed in a wellbore, wherein the second tubular is disposed within the first tubular;

shearing a shear pin of the tubing joint assembly that is provided between the first tubular and the second tubular;

axially moving one of the first tubular or the second tubular within the tubing joint assembly;

extending a cable coupled to the tubing joint assembly while axially moving one of the first tubular or the second tubular;

locking the second tubular to the first tubular with a locking device after the axially moving one of the first tubular or the second tubular;

conveying power from a power source at a surface of the wellbore down to the cable via an electric cable or hydraulic line extending from the surface of the wellbore; and providing power to a downhole tool below the tubing joint assembly via the cable.

15. The method of claim 14, wherein the locking of the locking device comprises a plurality of dogs coupled to the second tubular latching into an internal groove formed on an inner surface of the first tubular to lock the second tubular to the first tubular in a locked position.

16. The method of claim 15, further comprising spring-loading the plurality of dogs.

17. The method of claim 14, wherein the axially moving one of the first tubular or the second tubular within the tubing joint assembly comprises extending the second tubular out of the tubing joint assembly to have a length out of the first tubular.

18. The method of claim 14, further comprising isolating the plurality of dogs with a seal radially extending from the second tubular to the first tubular.

19. The method of claim 14, further comprising forming a continuous cable to the downhole tool with the electric cable or hydraulic line connected to the cable.

20. The method of claim 14, further comprising changing a temperature or fluid property in the wellbore, wherein the changing the temperature causes the shrinking or elongating the first tubular and/or the second tubular.

* * * * *